US007355577B1

(12) United States Patent
Bell et al.

(10) Patent No.: US 7,355,577 B1
(45) Date of Patent: Apr. 8, 2008

(54) LINEAR DAC IN LIQUID CRYSTAL DISPLAY COLUMN DRIVER

(75) Inventors: Marshall J. Bell, Chandler, AZ (US); Richard I. McCartney, Scotts Valley, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 728 days.

(21) Appl. No.: 10/850,973

(22) Filed: May 21, 2004

(51) Int. Cl.
*G09G 3/36* (2006.01)

(52) U.S. Cl. ..... 345/87; 345/98; 345/99; 345/100

(58) Field of Classification Search ..... 345/87, 345/98, 99, 100
See application file for complete search history.

(56) References Cited

U.S. PATENT DOCUMENTS

| | | | | |
|---|---|---|---|---|
| 6,788,231 | B1 * | 9/2004 | Hsueh | 341/135 |
| 6,801,149 | B2 | 10/2004 | Walton et al. | |
| 6,930,665 | B2 | 8/2005 | Sekine et al. | |
| 2002/0063666 | A1 * | 5/2002 | Kang et al. | 345/87 |
| 2005/0099549 | A1 * | 5/2005 | Chen et al. | 349/41 |
| 2006/0192741 | A1 * | 8/2006 | Hirakawa et al. | 345/98 |

OTHER PUBLICATIONS

National Semiconductor Corporation, "LCD TV TFT-LCD Timing Controller with PPDS Interface", FPD48084, May 2004, pp. 1-2.
U.S. Appl. No. 10/850,972, filed May 21, 2004.
U.S. Appl. No. 10/850/972, Restriction Requirement, filed Mar. 20, 2007.
U.S. Appl. No. 10/850,972, Non-Final Office Action, filed Jul. 13, 2007.

* cited by examiner

*Primary Examiner*—Richard Hjerpe
*Assistant Examiner*—Leonid Shapiro
(74) *Attorney, Agent, or Firm*—Darby & Darby PC; John W. Branch

(57) ABSTRACT

A method and circuit for providing analog voltages to an LCD panel based on digital voltages. A gamma curve defining a relationship between the applied voltage and a luminescence of the liquid crystals is implemented in a timing controller through a look-up table, an algorithm, and the like. The digital grey level voltages provided by the timing controller are converted to analog voltages by a linear digital-analog-converter (DAC) in each column driver. Implementation of the gamma curve in the timing controller and use of linear DAC allows accommodation of higher bit rate without significant die area increase. Furthermore, look-up table style implementation of the gamma curve allows for easy modification of the curve for temperature, color temperature, different color schemes, and the like.

17 Claims, 3 Drawing Sheets

LINEAR DAC IN LIQUID CRYSTAL DISPLAY COLUMN DRIVER

FIELD OF THE INVENTION

The present invention relates to Liquid Crystal Display (LCD) drivers, and, in particular, to a linear digital-analog-conversion (DAC) circuit implemented in an LCD column driver.

BACKGROUND

With major advances in various aspects of LCD technology, LCD's are being employed in many devices ranging from color cellular phone displays to most sophisticated medical equipment. This diversity of use affects different characteristics of LCDs. For example, durability, robustness, and the like are desirable for LCD panels to work under a wide range of circumstances such as temperature, humidity, mechanical stress, and the like.

For LCD's to be implemented in high end video applications such as large screen TV's, a capability to handle large amount of data, to provide brightness uniformity, compensate for temperature-induced gamma gradients, and the like are desirable of the LCD circuitry. While addressing these issues, the size of circuitry from a manufacturing cost and reliability perspective is among parameters that are taken into consideration.

Thus, it is with respect to these considerations and others that the present invention has been made.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description of the Invention, which is to be read in association with the accompanying drawings, wherein.

DETAILED DESCRIPTION

Figure 1:
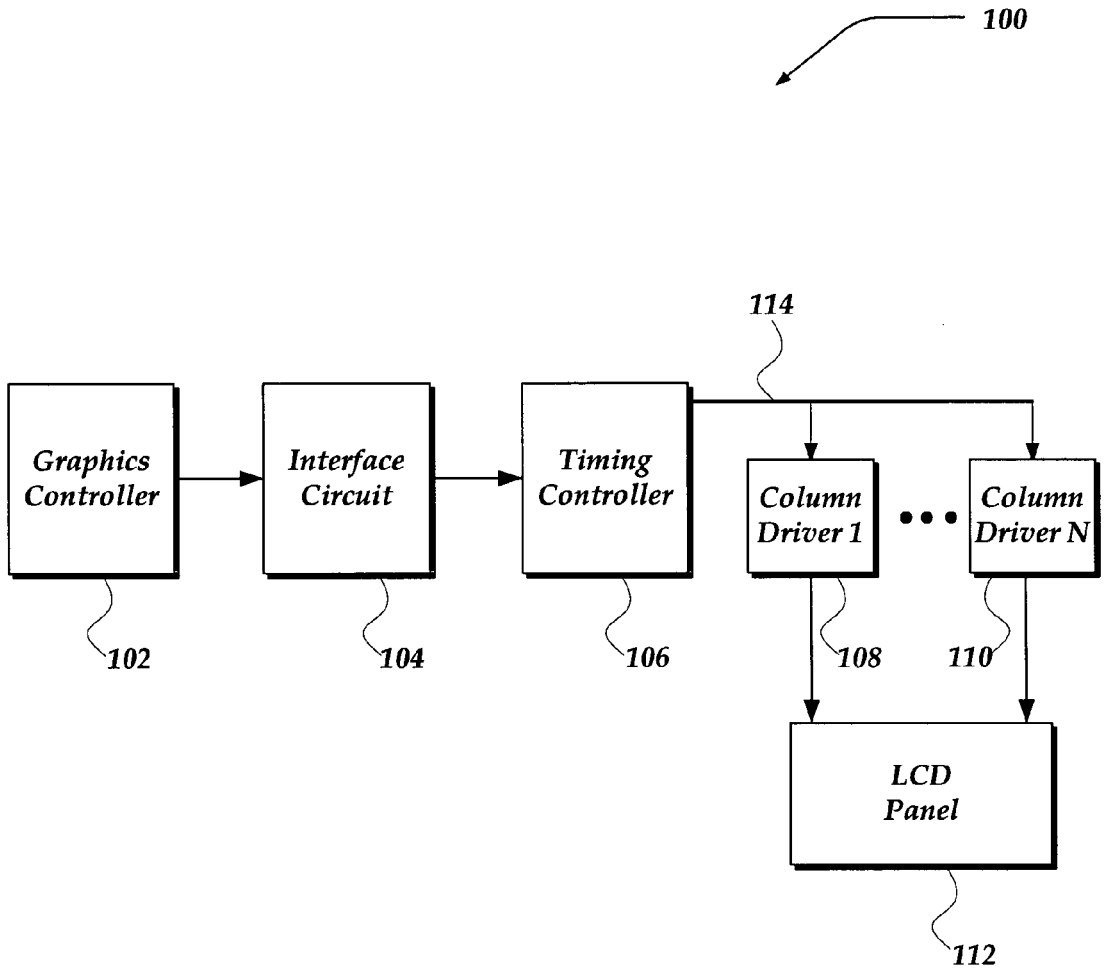
FIG. 1 illustrates a block diagram of an embodiment of an LCD system in which the present invention may be employed.

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment or an embodiment combining software and hardware aspects. The following detailed description is, therefore, not to be taken in a limiting sense.

Briefly stated, the present invention is related to a linear digital-analog-conversion circuit that provides an alternative to non-linear resistive DAC circuitry commonly used in LCD column drivers by implementing a gamma function in a timing controller instead of the LCD column driver.

In a typical LCD circuit, digital voltages that are generated in a graphics controller, the timing controller, and the like are converted to analog voltages for liquid crystals by a DAC circuit in the column driver such as a resistive DAC circuit. Gamma is a value of an exponent in an exponential electro-optic response curve. Unlike Cathode Ray Tubes (CRTs) which have exponential electro-optic response curves, LCDs do not have gammas, since their responses are not exponential. Liquid crystals respond to square of applied voltage. However, a gamma curve is employed in some LCDs to reduce the effect of the non-exponential behavior between the non-linear DAC circuit and the LCD. Such a gamma curve may be implemented to calibrate an LCD during manufacturing, but temperature dependencies, and the like, may necessitate application of different gamma curves by software, use of different circuitry, and the like, during operation of the circuit as well.

As mentioned above, LCDs respond to square of applied voltage. This enables designers to employ equal numbers of positive and negative voltages such that an average DC voltage applied to the LCD is about zero. A result of applying about zero DC voltage is prevention of ionization of contaminants in the LCD thereby increasing reliability of the display. The employment of equal numbers of positive and negative voltages, however, doubles a number of necessary bus lines in a timing controller circuit and a number of voltages to be decoded by a decoder in the circuit. For example, a 6-bit resistive LCD driver circuit may employ 64 positive and 64 negative voltages resulting in 128 bus lines from the timing controller to the column driver. In a typical LCD driver circuit, the decoder and a communication bus take up to 60% of a die area. A bit size increase from 6-bit to 8-bit translates to about quadrupling of the decoder and communication bus area, significantly increasing the size of the chip comprising the circuit.

By employing a linear DAC in the column driver and implementing the gamma curve in form of a look-up table in the timing controller, the present invention allows implementation of higher bit rates without significant growth of chip size. More information (10-bit in case of 8-bit system) has to be transported from the timing controller to the column driver, but die size of the column driver remains relatively small reducing manufacturing cost and reliability associated risks.

Furthermore, the gamma curve defining the electro-optic relationship between the liquid crystals and the applied voltage is temperature dependent. By employing a look-up table to generate the voltages, modification of the voltage levels based, in part, on the temperature is enabled. Multiple look-up tables may be employed for different temperature ranges providing consistent luminescence of the LCD.

Another aspect of LCD operation is consistency of color luminescence. Commonly used color LCDs employ red-blue-green-white pixel mosaics that use red, blue, and green as primary colors. A combination of all three primary colors provides the color white. However, each primary color may respond slightly differently to applied voltage even if the voltage is the same. This may result in different shades of white, termed color temperature, for different voltage levels.

Employing look-up tables for each primary color, that may include correction factors for color temperature, may allow a consistent color temperature over a dynamic range of the LCD. Moreover, the system according to the present invention may be easily implemented for other color schemes such as red-green-blue-green pixel mosaics.

Essentially, the present invention enables a diverse new LCD driver circuit, that allows higher bit rates without a significant increase in circuit size and easy correction of the gamma curve through use of look-up table in the timing controller. The circuit described herein may be employed with any LCD known to those skilled in the art.

FIG. 1 illustrates block diagram 100 of an embodiment of an LCD system in which the present invention may be employed. Block diagram 100 includes graphics controller 102, interface circuit 104, timing controller 106, column drivers 108-110, LCD panel 112, and communication bus 114.

Graphics controller 102 is arranged to receive input from a variety of source including, but not limited to, a central processing unit (CPU), an external processor, and the like. Graphics controller 102 is further arranged to perform processes associated with controlling LCD panel 112 and may include subcircuits such as a memory, a processor, and the like. Graphics controller 102 is coupled to interface circuit 104, which is arranged to provide communication between different components of the LCD system. Interface circuit 104 may comprise separate or integrated transmitters and receivers that enable large amounts of data to be transferred between graphics controller 102 and timing controller 106. In one embodiment, interface circuit 104 may be a Low-Voltage-Digital-Signaling (LVDS) interface Timing controller 106, is arranged to process data, control, and clock signals. In a typical LCD system, timing controller 106 may comprise an LVDS receiver and a line memory to provide digital voltages to the column drivers. The present invention includes an implementation of the gamma curve in timing controller 106 allowing generation of voltages for each grey level in the timing controller. This in return allows a simple linear digital-to-analog conversion in the next stage column drivers. The voltages generated in timing controller 106 are transmitted to the next stage of the LCD system, the column drivers, via communication bus 114. When the gamma curve is implemented in timing controller 106, communication bus 114 does not need to include a line for each possible voltage.

Column drivers 108-110 receive grey level voltages from timing controller 106 and provide an analog voltage to a column of pixel mosaics in LCD panel 112 modifying the luminescence of liquid crystals. Column drivers 108-110 may include a linear current mode DAC, R2R string DAC, binary weighted switched capacitor DAC, ramp pick-off DAC, charge redistribution DAC, and the like to convert the grey level voltages to analog voltages.

LCD panel 112 comprises individual pixel mosaics that change their luminescence based on an applied voltage. LCD panel 112 may be constructed such that individual pixel mosaics are driven in columns. Each column in LCD panel 112 may be supplied with the voltage by a column driver such as column drivers 108-110. LCD panel 112 may employ various technologies including, but not limited to, simple matrix, active matrix, and the like.

FIG. 1 shows a particular arrangement of inputs and outputs of the various components. In one embodiment, all of the components of the LCD system except LCD panel 112 may be included in the same chip. Alternatively, one or more of the components of the LCD system may be off-chip.

Figure 2:
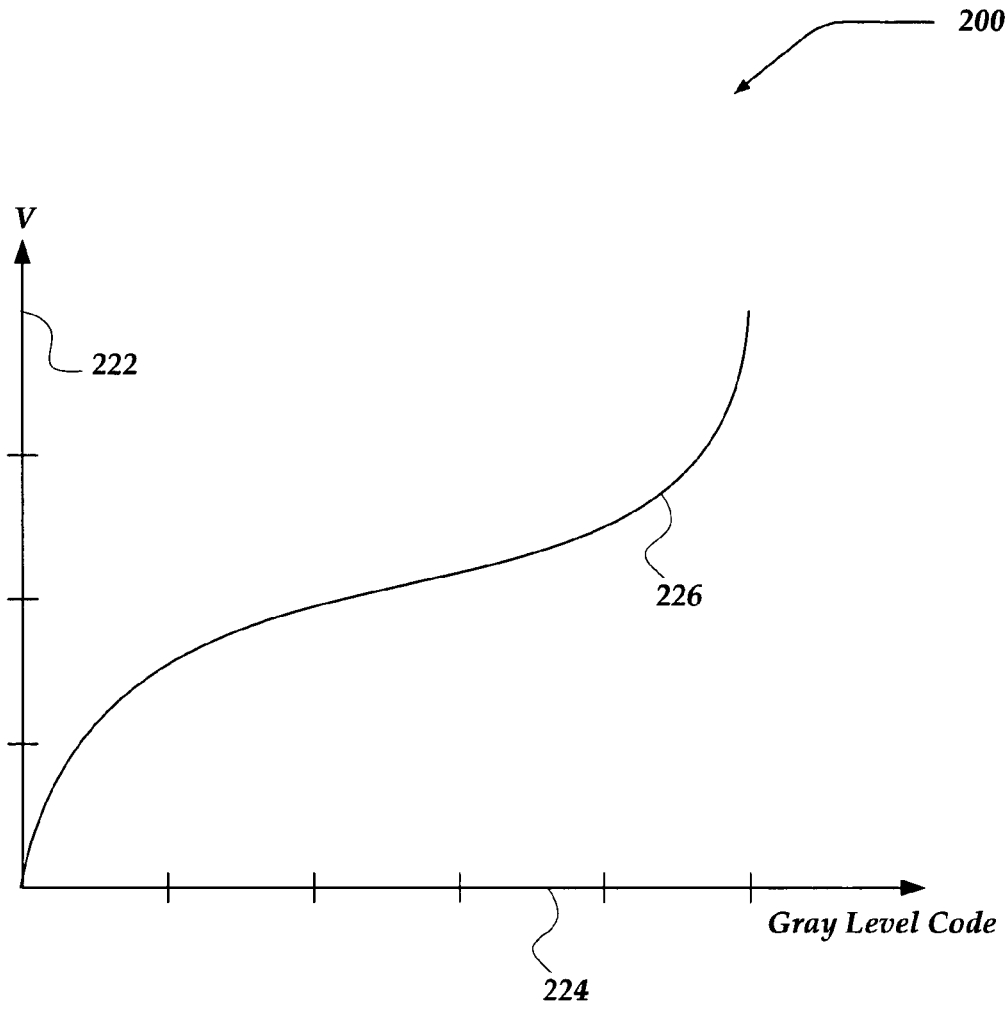
FIG. 2 illustrates a typical gamma curve defining a relationship between voltage and grey level code.

FIG. 2 illustrates a typical gamma curve defining a relationship between voltage and grey level code. Vertical axis 222 represents a voltage applied to the liquid crystals, and horizontal axis 224 represents gray level code, in other terms, a luminescence of the liquid crystals. Gamma curve 226 defines the relationship between applied voltage and the luminescence of the liquid crystals in the LCD panel. As mentioned above, liquid crystals respond to square of applied voltage. However, gamma curve 226 is employed in some LCDs to reduce the effect of the non-exponential behavior between the non-linear DAC circuit and the LCD. Gamma curve 226 may be implemented to calibrate an LCD during manufacturing, but temperature dependencies, and the like, may necessitate application of different gamma curves by software, use of different circuitry, and the like.

Color LCDs employ pixel mosaics comprising a set of primary color pixels such as a red-blue-green-white mosaic. In such displays a different gamma curve may be employed for each primary color. A combination of primary colors for a given voltage yields a white color on the LCD. If the luminescence of one or more of the primary colors is not equally weighted, the combination white color may have a slight hue depending on which primary color prevails. This deviation of the white color from the equally weighted normal is called color temperature. A varying color temperature depending on the applied voltage level may not be desirable to a user. Therefore, correction factors for individual gamma curves of each primary color may be desired. By enabling implementation of gamma curve 226 in a look-up table in the timing controller, the present invention allows use of correction factors for each primary color. Since each LCD panel may have a different color temperature characteristic, individual gamma curves may be modified in a calibration process during manufacturing.

Furthermore, gamma curve 226 is also dependent on temperature. To preserve a luminescence consistency over a predetermined temperature range, multiple gamma curves may be determined for different temperatures. In one embodiment, the graphics controller may determine the temperature and modify gamma curve 226 accordingly. This may be accomplished by replacing gamma curve 226 with another gamma curve that is stored in a memory such as a ROM, RAM, EEPROM, and the like. In another embodiment, the graphics controller may be enabled to modify gamma curve 226 dynamically according to a predetermined algorithm.

Gamma curve 226 may be implemented as a look-up table, a table with interpolation, an algorithm, and the like. In one embodiment, gamma curve 226 may be pre-programmed during manufacturing. In another embodiment, gamma curve 226 may be provide by an external processor. Individual gamma curves for primary colors may be implemented to support additional color schemes such as red-blue-green-green pixel mosaics, and the like.

Figure 3:
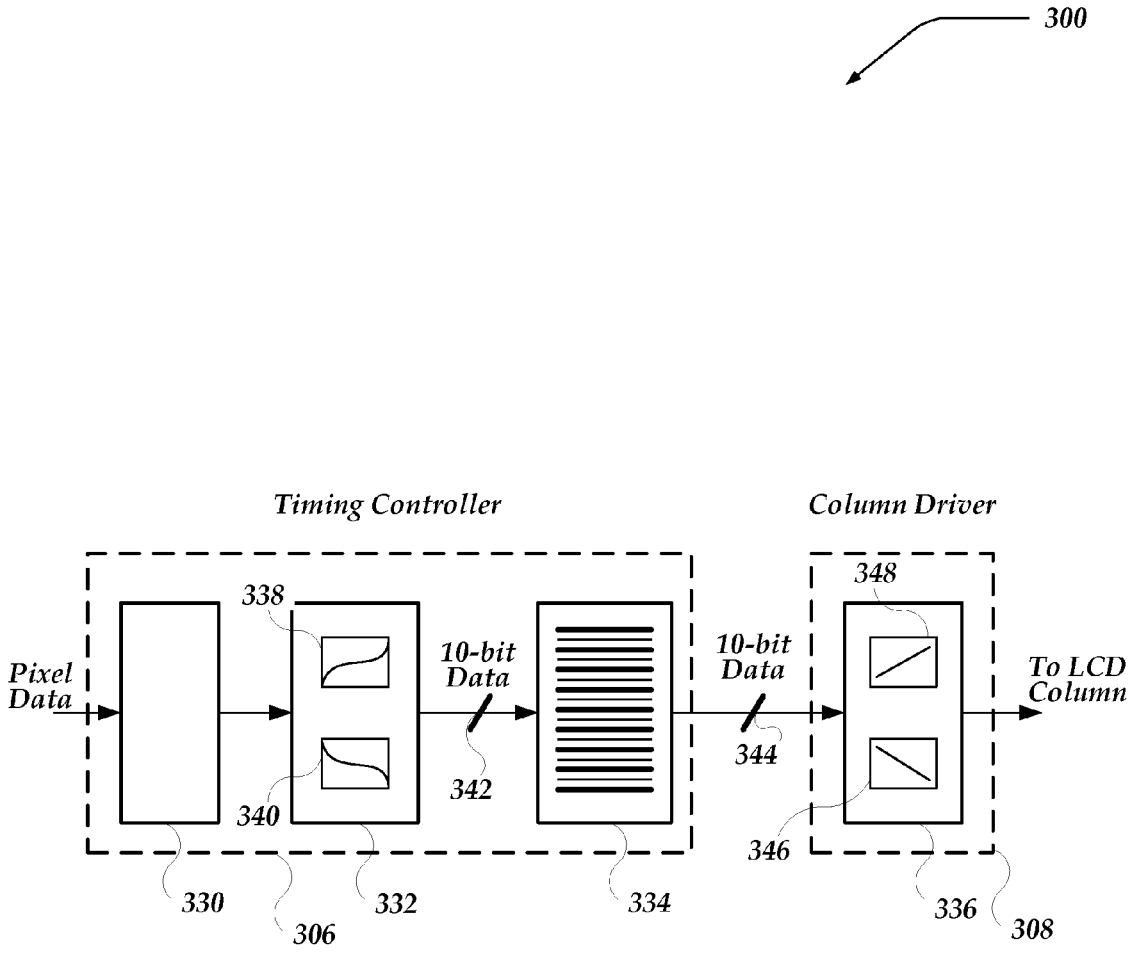
FIG. 3 illustrates a block diagram of a timing controller and a column driver for an 8-bit LCD driver circuit according to the present invention.

FIG. 3 illustrates block diagram 300 of a timing controller and a column driver for an 8-bit LCD driver circuit implementing the present invention. Block diagram 300 includes timing controller 306 and column driver 308.

Timing controller 306 is arranged to receive pixel data from a graphics controller, and the like, process the data, and provide 10-bit digital grey level voltages to column driver 308 via a communication bus. The timing controller's output may be provided via a communication bus to a predetermined number of column drivers, of which column driver 308 is representative.

Column driver 308 is arranged to receive the digital grey level voltages from timing controller 306, convert them employing a linear Digital-Analog-Converter (DAC) to analog voltages and provide those voltages to an LCD column in an LCD panel.

Timing controller 306 includes receiver 330, look-up table 332, and line memory 334. Look-up table 332 and line memory 334 communicate via 10-bit data line 342 as shown in the figure. The figure is intended to show an exemplary configuration of a timing controller for an 8-bit LCD system, where 10-bit data transfer is necessary as described below. However, the invention is not so limited. Other data rates such as 6-bit, 10-bit, and the like may be employed in a similar fashion without departing from the scope and spirit of the invention. Furthermore, the figure shows one look-up table. Other embodiments may include multiple look-up tables, for example three tables for a red-blue-green-white pixel mosaic application.

Receiver 330 is configured to receive pixel data and transfer to look-up table 332. In one embodiment, receiver 330 may be an LVDS receiver. Look-up table 332 is an embodiment of an implementation of the gamma curve described in conjunction with FIG. 2. As described below, the gamma curve defines a relationship between an applied voltage and a luminescence of liquid crystals. The gamma curve may be implemented, in addition to the look-up table, by an interpolation, an algorithm, and the like. Because use of equal numbers of positive and negative voltages to achieve an average, about zero DC voltage is common practice, look-up table 332 may comprise upper look-up table 338 and lower look-up table 340. In one embodiment, upper look-up table 338 and lower look-up table 340 may be identical except for a negative sign for values in lower look-up table 340. In another embodiment, both tables may include different adjustment factors such as correction factors for color temperature.

In a further embodiment, timing controller 306 may include three look-up tables, one for each primary color in a pixel mosaic of a color LCD panel. For consistent color temperature across a voltage range, each table may include correction factors for the corresponding primary color. This way, despite application of different grey level voltages to each pixel the same luminescence may be obtained.

Look-up table 332 may further be modified to provide consistent luminescence over a temperature range. Such modification may be implemented by updating look-up table 332, downloading a new set of values for look-up table 332, recalculating stored values using an algorithm, and the like.

Upon implementation of the gamma curve in look-up table 332, digital voltages reflecting grey levels are generated and stored in line memory 334. Digital voltages reflecting grey levels are then transmitted to column driver 308 via 10-bit communication line 344 for digital-analog conversion. Because column driver 308 employs linear DAC 336 according to the present invention, an N+2 bit resolution may be necessary to resolve virtually all points of N-bit gray code data to unique points on the gamma curve. For example, for an 8-bit LCD system, look-up table 332 may generate 10-bit data that is transferred via the line memory, to the 10-bit linear DAC in column driver 308. Similarly, a 10-bit system would need 12-bit linear DAC, and the like.

As mentioned above, column driver 308 is representative of a predetermined number of column drivers for an LCD panel. In a typical column driver, the gamma curve would be implemented employing a non-linear DAC. This may lead to size related problems when data rate is increased, as described above. Furthermore, each gamma curve would require a custom die in that configuration. Because the gamma curve is implemented through a look-up table, algorithm, and the like, in timing controller 306 according to the present invention, linear DAC 336 may be implemented in column driver 308 saving significant amount of chip area. Linear DAC 336 may include sub-DAC 346 for lower look-up table and sub-DAC 348 for upper look-up table to address positive and negative grey level voltages. Linear DAC 336 may be implemented as current mode, R2R string, binary weighted switched capacitor, ramp pick-off, charge redistribution type, and the like. Analog voltages generated by the linear DAC in response to digital grey level voltages may then be supplied to a column in the LCD panel.

The above specification, examples and data provide a description of the manufacture and use of the composition of the invention. Since many embodiments of the invention can be made without departing from the spirit and scope of the invention, the invention also resides in the claims hereinafter appended.

We claim:

1. An LCD driving circuit, comprising:

a timing controller that is arranged to receive pixel data, generate a digital grey level voltage based on the received pixel data and a predetermined gamma curve, store the digital voltage, and provide the digital voltage to a column driver; and a column driver that is arranged to receive the digital grey level voltage, convert to an analog voltage, and provide the analog voltage to an LCD column, wherein the digital grey level voltage is converted to the analog voltage by a linear digital-analog-converter (DAC) in the column driver, and wherein the gamma curve and the linear DAC are arranged to support a color scheme including at least one of a red-blue-green-white pixel mosaic or a red-blue-green-green pixel mosaic.

2. The circuit of claim 1, wherein the linear DAC includes at least one of a current mode DAC, R2R string DAC, binary weighted switched capacitor DAC, ramp pick-off DAC, or charge redistribution type DAC.

3. The circuit of claim 1, wherein the predetermined gamma curve is implemented through at least one of a look-up table, an interpolation, or an algorithm.

4. The circuit of claim 3, wherein the gamma curve is stored in at least one of a ROM, a RAM, or an EEPROM.

5. The circuit of claim 1, wherein the predetermined gamma curve is downloaded from an external source.

6. The circuit of claim 1, wherein the timing controller employs at least three gamma curves for generating a digital grey level voltage for each of a triplet of primary colors to be used in a color LCD panel.

7. The circuit of claim 6, wherein each gamma curve includes at least one correction factor for the corresponding primary color to achieve consistent color temperature.

8. The circuit of claim 1, wherein the gamma curve is modified to compensate for a temperature dependent variation in liquid crystal luminescence.

9. The circuit of claim 1, wherein the timing controller further includes a sample-and-hold circuit.

10. A method for driving an LCD panel, comprising:

receiving pixel data;

storing a predetermined gamma curve, wherein the gamma curve determines a relationship between an applied voltage and a luminescence of an LCD column;

generating a digital grey level voltage based on the received pixel data and the gamma curve;

storing the digital voltage;

transmitting the digital voltage to a column driver;

converting the digital voltage to an analog voltage at the column driver; and providing the analog voltage to the LCD column, wherein converting the digital voltage to an analog voltage is performed employing a linear conversion method, and wherein a color scheme including at least one of a red-blue-green-white pixel mosaic or a red-blue-green-green pixel mosaic is supported.

11. The method of claim 10, wherein the gamma curve is implemented through at least one of:

storing and retrieving the gamma curve in a look-up table;

interpolating a value of the gamma curve from a set of stored values; or employing a predetermined algorithm.

12. The method of claim 10, wherein the gamma curve is loaded to a storage means during manufacturing.

13. The method of claim 10, wherein the gamma curve is retrieved from an external source during operation.

14. The method of claim 10, further comprising employing at least three gamma curves for generating a digital grey level voltage for each of a triplet of primary colors to be used in a color LCD panel.

15. The method of claim 14, further comprising modifying each gamma curve with at least one correction factor for the corresponding primary color to achieve consistent color temperature.

16. The method of claim 10, further comprising modifying the gamma curve to compensate for a temperature dependent variation in liquid crystal luminescence.

17. An LCD driving circuit, comprising:

a means for receiving pixel data;

a means for storing a predetermined gamma curve;

a means for generating a digital grey level voltage based on the received pixel data and the predetermined gamma curve;

a means for storing the digital voltage;

a means for converting the digital voltage to an analog voltage through linear conversion means; and a means for providing the analog voltage to an LCD column, wherein the gamma curve and the linear conversion means are arranged to support a color scheme including at least one of a red-blue-green-white pixel mosaic or a red-blue-green-green pixel mosaic.

* * * * *